US008816803B2

(12) United States Patent
Naka et al.

(10) Patent No.: US 8,816,803 B2
(45) Date of Patent: Aug. 26, 2014

(54) CONTACT MECHANISM AND ELECTROMAGNETIC CONTACTOR USING SAME

(75) Inventors: Yasuhiro Naka, Kounosu (JP); Kouetsu Takaya, Kounosu (JP); Kenji Suzuki, Kounosu (JP)

(73) Assignees: Fuji Electric Fa Components & Systems Co., Ltd., Tokyo (JP); Fuji Electric Co., Ltd., Kawasaki-shi (JP)

( * ) Notice: Subject to any disclaimer, the term of this patent is extended or adjusted under 35 U.S.C. 154(b) by 0 days.

(21) Appl. No.: 13/640,612

(22) PCT Filed: Jun. 14, 2011

(86) PCT No.: PCT/JP2011/003376

§ 371 (c)(1),
(2), (4) Date: Dec. 21, 2012

(87) PCT Pub. No.: WO2012/014368

PCT Pub. Date: Feb. 2, 2012

(65) Prior Publication Data

US 2013/0113580 A1 May 9, 2013

(30) Foreign Application Priority Data

Jul. 27, 2010 (JP) ..... 2010-168176

(51) Int. Cl.

| | |
|---|---|
| ***H01H 1/00*** | (2006.01) |
| ***H01H 50/54*** | (2006.01) |
| ***H01H 1/54*** | (2006.01) |
| ***H01H 1/06*** | (2006.01) |

(52) U.S. Cl.

CPC ..... *H01H 1/06* (2013.01); *H01H 50/546* (2013.01); *H01H 1/54* (2013.01)

USPC ..... 335/196; 335/133

(58) Field of Classification Search

CPC ..... H01H 1/54; H01H 1/20; H01H 77/101; H01H 50/00; H01H 50/54; H01H 50/546; H01H 31/24; H01H 3/222

USPC ..... 335/78, 128, 133, 196

See application file for complete search history.

(56) References Cited

U.S. PATENT DOCUMENTS 4,540,963 A * 9/1985 Esterl et al. ..... 335/133
5,132,653 A * 7/1992 Nakatake et al. ..... 335/202

(Continued)

FOREIGN PATENT DOCUMENTS

JP S60-41724 3/1985
JP U-H01-70246 5/1989

(Continued)

*Primary Examiner* — Bernard Rojas
(74) *Attorney, Agent, or Firm* — Manabu Kanesaka

(57) ABSTRACT

The present invention provides a contact mechanism that is capable of, without enlarging the entire configuration thereof, preventing the generation of an electromagnetic repulsion that opens a movable contact upon application of a current, and also provides an electromagnetic contactor that uses this contact mechanism. A contact mechanism (CM) has a fixed contact (2) and a movable contact (3) that are inserted in a current-carrying path. In the contact mechanism (CM), at least either the fixed contact (2) or the movable contact (3) is formed into an L-shape or a U-shape so as to generate a Lorentz force that acts against an electromagnetic repulsion in an opening direction, which is generated between the fixed contact (2) and the movable contact (3) upon application of a current.

5 Claims, 5 Drawing Sheets

(56) References Cited

U.S. PATENT DOCUMENTS

| | | | | |
|---|---|---|---|---|
| 5,430,420 | A * | 7/1995 | Maier | 335/16 |
| 6,075,429 | A * | 6/2000 | Uotome et al. | 335/78 |
| 6,700,466 | B1 * | 3/2004 | Yamamoto et al. | 335/132 |
| 7,145,422 | B2 * | 12/2006 | Imanishi et al. | 335/201 |
| 7,902,948 | B2 * | 3/2011 | Luders | 335/201 |
| 8,319,587 | B2 * | 11/2012 | Durand et al. | 335/202 |
| 2013/0021121 | A1 * | 1/2013 | Uchida | 335/131 |
| 2013/0106543 | A1 * | 5/2013 | Isozaki et al. | 335/201 |
| 2013/0229247 | A1 * | 9/2013 | Tachikawa et al. | 335/196 |
| 2013/0229248 | A1 * | 9/2013 | Yokoyama et al. | 335/201 |
| 2013/0335175 | A1 * | 12/2013 | Tachikawa et al. | 335/147 |
| 2014/0062627 | A1 * | 3/2014 | Naka et al. | 335/189 |

FOREIGN PATENT DOCUMENTS

| | | |
|---|---|---|
| JP | 04-123719 | 4/1992 |
| JP | U-H05-25644 | 4/1993 |
| JP | 2001-210170 | 8/2001 |

* cited by examiner

CONTACT MECHANISM AND ELECTROMAGNETIC CONTACTOR USING SAME

RELATED APPLICATIONS

The present application is National Phase of International Application No. PCT/JP2011/003376 filed Jun. 14, 2011, and claims priority from Japanese Application No. 2010-168176, filed Jul. 27, 2010.

TECHNICAL FIELD

The present invention relates to a contact mechanism having a fixed contact and a movable contact inserted in current path, and to an electromagnetic contactor that uses this contact mechanism, whereby a Lorentz force acting against an electromagnetic repulsion to separate the movable contact from the fixed contact is generated when the electromagnetic contactor is applied with a current.

BACKGROUND ART

As a contact mechanism for opening/closing a current path, there has conventionally been proposed a switch, such as a circuit breaker or an electromagnetic contactor. In such a switch that generates an arc when cutting off a current, a fixed contact applied thereto is folded into a U-shape as viewed laterally, and a fixed contact point is formed on the folded part of the U-shape. Furthermore, a movable contact point of a movable contact is disposed on this fixed contact point so as to be capable of contacting with and separating from the fixed contact point. The switch increases an opening speed of the movable contact by increasing an electromagnetic repulsion that acts on the movable contact when cutting off a large current, to drastically expand the arc (see Patent Literature 1, for example).

There has also been proposed a contact structure of an electromagnetic contactor in which a magnetic field generated by a flowing current drives an arc in the same configuration as the configuration described above (see Patent Literature 2; for example).

Patent Literature 1: Japanese Patent Application Publication No. 2001-210170

Patent Literature 2: Japanese Patent Application Publication No. H4-123719

Incidentally, the prior art described in Patent Literature 1 increases an electromagnetic repulsion that is generated by forming the fixed contact into a U-shape as viewed laterally. The increased electromagnetic repulsion consequently increases the opening speed of the movable contact to drastically expand the arc, the opening speed being obtained when cutting off a large current generated due to short circuit and the like. In this manner, the value of an accidental current can be restricted to a small value.

However, the electromagnetic contactor that is combined with a fuse or a circuit breaker to configure a circuit is required to inhibit the electromagnetic repulsion from opening the movable contact when a large current is applied thereto due to short circuit. The prior art described in Patent Literature 2, therefore, satisfies the requirement by increasing a spring force of a contact spring for ensuring a contact pressure of the movable contact on the fixed contact.

DISCLOSURE OF THE INVENTION

Increasing the contact pressure of the contact spring as described above leads to the necessity of increasing a thrust that is generated by an electromagnet driving the movable contact, enlarging the entire configuration. Alternatively, the electromagnetic contactor needs to be combined with a fuse or a circuit breaker that provides a higher current-limiting effect and is excellent in cutoff performance.

The present invention, therefore, is conceived in view of the unsolved problems of the prior arts described above, and aims to provide a contact mechanism that is capable of, without enlarging the entire configuration thereof, preventing the generation of an electromagnetic repulsion that opens a movable contact upon application of a current, and also provide an electromagnetic contactor that uses this contact mechanism.

In order to achieve the object described above, a first aspect of a contact mechanism according to the present invention is a contact mechanism that has a fixed contact and a movable contact that are inserted in a current-carrying path. In this contact mechanism, at least either the fixed contact or the movable contact is shaped so as to increase a Lorentz force that acts against an electromagnetic repulsion in an opening direction, which is generated between the fixed contact and the movable contact upon application of a current.

According to this configuration, at least either the fixed contact or the movable contact is shaped into, for example, an L-shape or U-shape so as to generate the Lorentz force that acts against the electromagnetic repulsion in the opening direction, which is generated between the fixed contact and the movable contact upon application of a current. Therefore, the movable contact can be prevented from opening upon application of a large current.

Furthermore, in a second aspect of the contact mechanism according to the present invention, the movable contact has a conductive plate that is supported by a movable part and has contact point parts on both ends of a front or rear surface thereof. Moreover, in the contact mechanism, the fixed contact has L-shaped conductive plate parts formed by a pair of fixed contact point parts facing the contact point parts of the conductive plate, first conductive plate parts that support the pair of fixed contact point parts and extend outward from the both ends of the conductive plate in parallel with the conductive plate, and second conductive plate parts each extending from an outer end part of each of the first conductive plate parts through the outside of an end part of the conductive plate.

According to this configuration, while the movable contact has the conductive plate formed thereon, the fixed contact has the L-shaped conductive parts formed by the first conductive plate parts and the second conductive plate parts, wherein a relationship between a magnetic flux that is formed in the second conductive plate parts upon application of a current and a current flowing through the first conductive plate parts, leads to the generation of a large Lorentz force in a direction to contact the movable contact with the fixed contact, against the electromagnetic repulsion in the opening direction, which is generated between the fixed contact and the movable contact upon application of a current.

In addition, in a third aspect of the contact mechanism according to the present invention, the fixed contact is configured into a U-shape by including third conductive plate parts each extending inward from an end part of each of the second conductive plate parts in parallel with the conductive plate.

According to this configuration, currents flow in opposite directions through the first and third conductive parts, generating, between the conductive plate of the movable contact and the third conductive plate parts of the fixed contact, an electromagnetic repulsion in a direction bringing the movable contact into contact with the fixed contact.

In addition, in a fourth aspect of the contact mechanism according to the present invention, the movable contact has a conductive plate part supported by a movable part, U-shaped folded parts formed on both ends of the conductive plate part, and contact point parts each formed on an opposing surface of each of the U-shaped folded parts facing the conductive plate part. The fixed contact has L-shaped conductive plate parts configured by a pair of first conductive plate parts respectively formed with contact point parts to contact with the contact point parts of the movable contact that are disposed parallel to the conductive plate part in the U-shaped folded parts, and second conductive plate parts each extending from an inner end of each of the pair of first conductive plate parts through the inner side of an end part of each of the U-shaped folded parts.

According to this configuration, the U-shaped folded parts are formed in the movable contact, and, by using current paths in the U-shaped folded parts, an electromagnetic repulsion is generated between the conductive plate part of the movable contact and the first conductive plate parts of the fixed contact to bring the movable contact into contact with the fixed contact.

Moreover, the first aspect of the electromagnetic contactor according to the present invention has the contact mechanism of any one of the first to fourth aspects, wherein the movable contact is coupled to a movable core of an operating electromagnet, and the fixed contact is connected to an external connecting terminal.

According to this configuration, the spring force of a contact spring that brings the movable contact into contact with the fixed contact can be reduced by generating the Lorentz force that acts against the electromagnetic repulsion opening the space between the movable contact and the fixed contact upon application of a current to the electromagnetic contactor. Consequently, the thrust of the electromagnet driving the movable contact can be reduced, providing a small electromagnetic contactor.

The present invention can generate the Lorentz force that acts against an electromagnetic repulsion in an opening direction, which is generated between the fixed contact and the movable contact when a large current is applied to the contact mechanism that has the fixed contact and the movable contact inserted in a current-carrying path. Therefore, the present invention can reliably prevent the movable contact from being opened upon application of a large current, without using a mechanical pressure.

BEST MODE FOR CARRYING OUT THE INVENTION

Embodiments of the present invention are described hereinafter with reference to the drawings.

Figure 1:
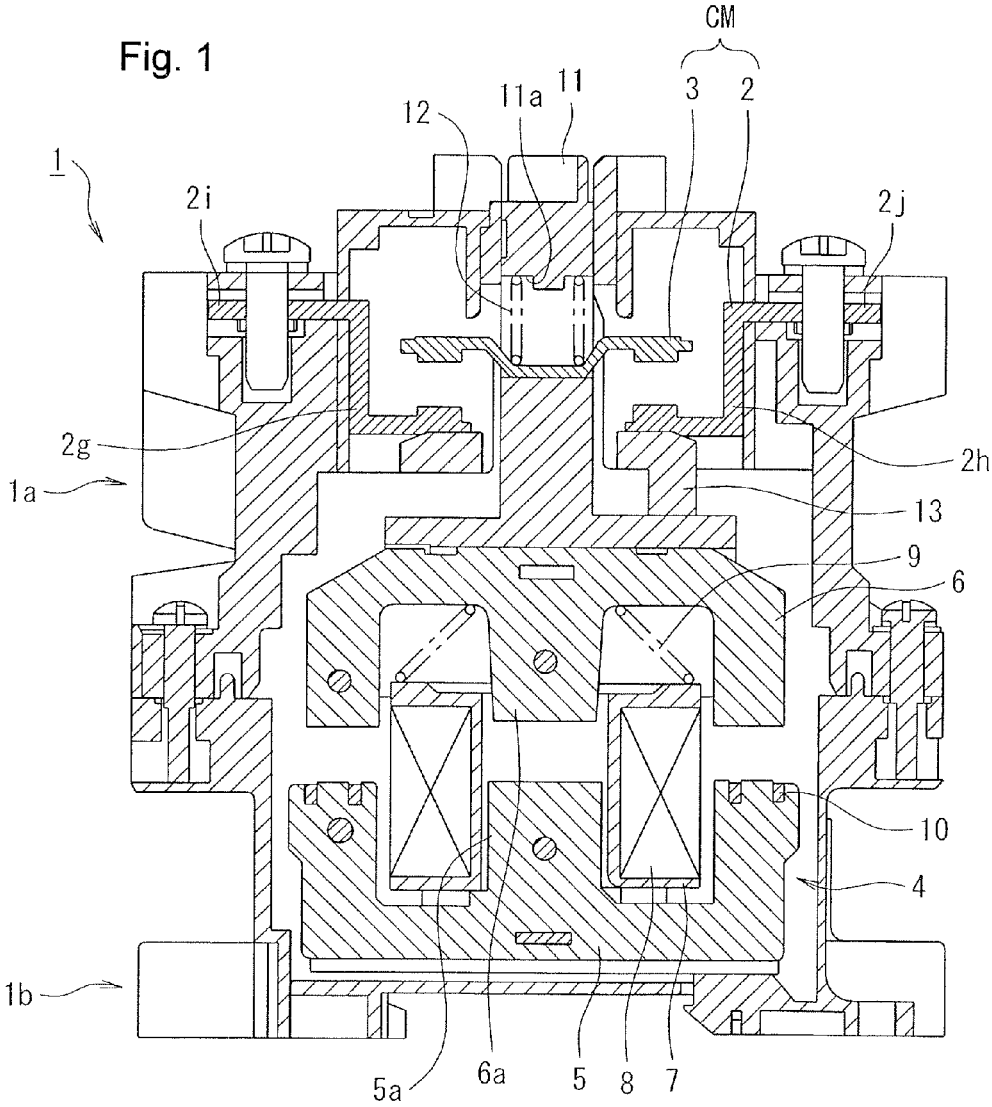
FIG. 1 is a cross-sectional view showing a first embodiment in which the present invention is applied to an electromagnetic contactor.
Figure 2A:
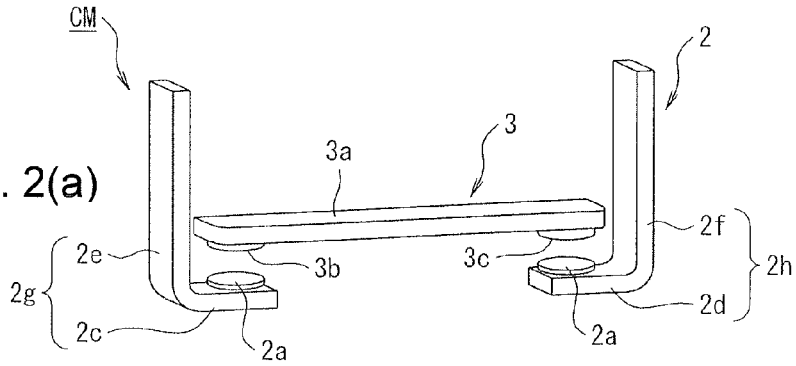
FIGS. 2(*a*)-2(*d*) are views showing a first embodiment of a contact mechanism of the present invention, wherein FIG. 2(*a*) is a perspective view, FIG. 2(*b*) is a cross-sectional view of the opened contact mechanism, FIG. 2(*c*) is a cross-sectional view of the closed contact mechanism, and FIG. 2(*d*) is a cross-sectional view showing a magnetic flux obtained when the contact mechanism is closed.
Figure 2B:
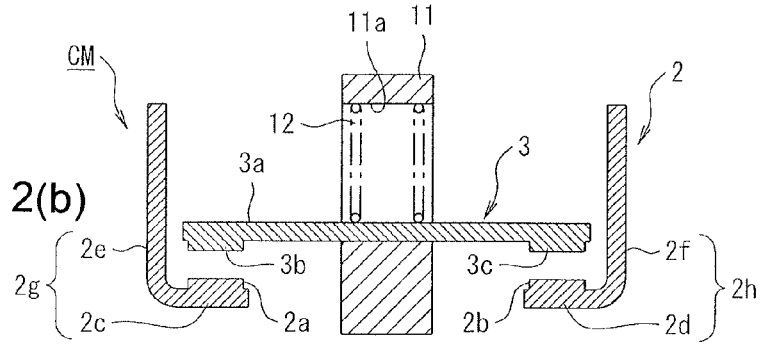
Figure 2C:
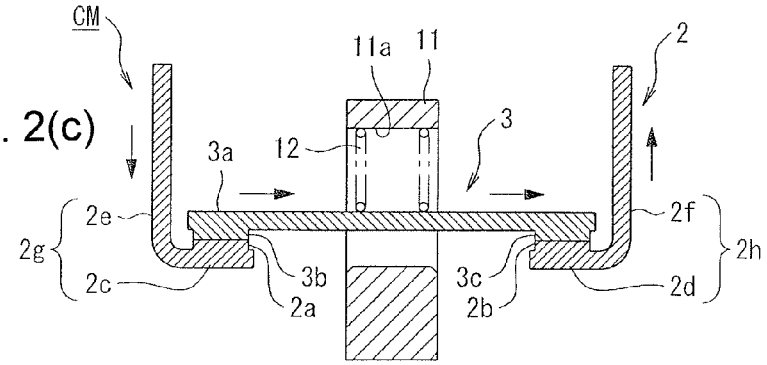
Figure 2D:
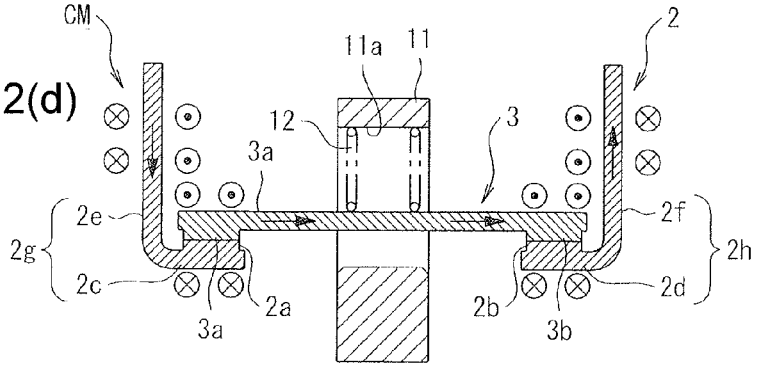

In FIG. 1, reference numeral 1 represents a main body case made from, for example, a synthetic resin. This main body case has a divided structure composed of an upper case 1*a* and a lower case 1*b*. The upper case 1*a* is internally installed with a contact mechanism CM. This contact mechanism CM has a fixed contact 2 that is fixedly placed in the upper case 1*a*, and a movable contact 3 that is disposed so as to be able to come into contact with and separate from the fixed contact 2.

An operating electromagnet 4 for driving the movable contact 3 is disposed in the lower case 1*b*. In this operating electromagnet 4, a fixed core 5 formed from a stacked steel plate having E-shaped legs and a movable core 6 similarly formed from a stacked steel plate having E-shaped legs are placed face-to-face.

An electromagnetic coil 8 that is installed in a wrapped manner in a coil holder 7 and supplied with a single-phase AC is fixed to a central leg part 5*a* of the fixed core 5. Furthermore, a return spring 9 is disposed between an upper surface of the coil holder 7 and a root of a central leg 6*a* of the movable core 6 in order to urge the movable core 6 away from the fixed core 5.

Moreover, a shading coil 10 is embedded in an upper end surface of each outer leg part of the fixed core 5. Providing this shading coil 10 can prevent the occurrence of fluctuations, noise and vibrations of an electromagnetic attracting force, which can be caused due to a change in an alternating magnetic flux in a single-phase AC electromagnet.

A contact holder 11 is coupled to an upper end of the movable core 6. This contact holder 11 is held by an insertion hole 11*a* that is formed at an upper end of the contact holder 11 in an axially perpendicular direction, in a manner that the movable contact 3 is pressed downward against the fixed contact by a contact spring 12 to obtain a predetermined contact pressure.

As shown in the enlarged diagrams in FIGS. 2(*a*)-2(*d*), this movable contact 3 is configured by an elongated rod-shaped conductive plate 3*a*, a central part of which is pressed by the contact spring 12. Movable contact point parts 3*b*, 3*c* are formed at both ends of a lower surface of this conductive plate 3*a*.

Also, as shown in the enlarged diagrams in FIG. 2(*a*)-2(*d*), the fixed contact 2 has L-shaped conductive plate parts 2*g*, 2*h*, which are formed by first conductive plate parts 2*c*, 2*d* that extend outward in parallel with the conductive plate 3*a* while supporting a pair of fixed contact point parts 2*a*, 2*b* facing lower sides of the movable contact point parts 3*b*, 3*c* of the movable contact 3, and second conductive plate parts 2*e*, 2*f* that extend upward through the outsides of end parts of the conductive plate 3*a* from outer end parts of the first conductive plate parts 2*c*, 2*d* outside the conductive plate 3*a*. Then, as shown in FIG. 1, external connecting terminals 2*i*, 2*j* extending and fixed on the outside of the upper case 1*a* are coupled to upper ends of the L-shaped conductive plate parts 2*g*, 2*h*.

Operations of the above-described first embodiment are described next.

When the electromagnetic coil 8 of the operating electromagnet 4 is in a non-conductive state, no electromagnetic attracting force is generated between the fixed core 5 and the movable core 6, and, consequently, the movable core 6 is urged by the return spring 9 to move upward away from the fixed core 5. The upper end of the movable core 6 is then abutting with a stopper 13 and accordingly held at a current cutoff position.

In a state in which the movable core 6 is held at the current cutoff position, the contact spring 12 brings the movable contact 3 into contact with a bottom part of the insertion hole 11*a* of the contact holder 11, as shown in FIG. 2(*b*). In such a state, the movable contact point parts 3*b*, 3*c* formed on the ends of the conductive plate 3*a* of the movable contact 3 separate upward from the fixed contact point parts 2*a*, 2*b* of the fixed contact 2, obtaining an opened state of the contact mechanism CM.

In this opened state of the contact mechanism CM, when a single-phase AC is supplied to the electromagnetic coil 8 of the operating electromagnet 4, an attracting force is generated between the fixed core 5 and the movable core 6, attracting the movable core 6 downward against the return spring 9. As a result, the movable contact 3 supported by the contact holder 11 descends, whereby the movable contact point parts 3*b*, 3*c* are contacting with the fixed contact point parts 2*a*, 2*b* of the fixed contact 2 by the contact pressure of the contact spring 12, obtaining a closed state of the contact mechanism CM.

In this closed state, a large current of approximately, for example, several tens of kA, which is input from the external connecting terminal 2*i* of the fixed contact 2 connected to a DC power source (not shown), is supplied to the movable contact point part 3*b* of the movable contact 3 via the second conductive plate part 2*e*, the first conductive plate part 2*c*, and the fixed contact point part 2*a*. The large current supplied to the movable contact point part 3*b* is supplied to the fixed contact point part 2*b* via the conductive plate 3*a* and the movable contact point part 3*c*. The large current supplied to the fixed contact point part 2*b* is supplied to the first conductive plate part 2*d*, the second conductive plate part 2*f*, and the external connecting terminal 2*j*, forming a current-carrying path supplied to an external load.

At this moment, an electromagnetic repulsion is generated in a direction of opening the movable contact point part 3*b*, 3*c*, between each of the fixed contact point parts 2*a*, 2*b* of the fixed contact 2 and each of the movable contact point parts 3*b*, 3*c* of the movable contact 3.

However, because the fixed contact 2 has the L-shaped conductive plate parts 2*g*, 2*h* formed by the first conductive plate parts 2*c*, 2*d* and the second conductive plate parts 2*e*, 2*f* as shown in FIG. 2, the fixed contact 2 forms a magnetic field shown in FIG. 2(*d*) with respect to the current flowing through the movable contact 3, due to the formation of the current path described above. For this reason, according to Fleming's left-hand rule, the Lorentz force acting against the abovementioned electromagnetic repulsion can be generated in the conductive plate 3*a* of the movable contact 3 to push the movable contact point parts 3*b*, 3*c* against the fixed contact point parts 2*a*, 2*b*.

Therefore, even when the electromagnetic repulsion that opens the movable contact 3 is generated, the Lorentz force acting against this electromagnetic repulsion can be generated, reliably preventing the movable contact 3 from being opened. Consequently, the pressure of the contact spring 12 supporting the movable contact 3 can be reduced, and therefore a thrust that is generated in the operating electromagnet 4 can also be reduced. As a result, the size of the entire configuration can be reduced.

In this case, it is only necessary to form the L-shaped conductive plate parts 2*g*, 2*h* in the fixed contact 2, so that the fixed contact 2 can be processed easily. In addition, it is not necessary to produce an additional member for generating an electromagnetic force or mechanical force acting against the abovementioned electromagnetic repulsion. Therefore, not only the number of components but also the size of the entire configuration can be prevented from growing.

Next, a second embodiment of the present invention is described with reference to FIGS. 3(*a*)-3(*c*).

In the second embodiment, the Lorentz force acting against the abovementioned electromagnetic repulsion is generated on the back of the movable contact, the electromagnetic repulsion being generated with respect to the fixed contact and the movable contact.

Figure 3A:
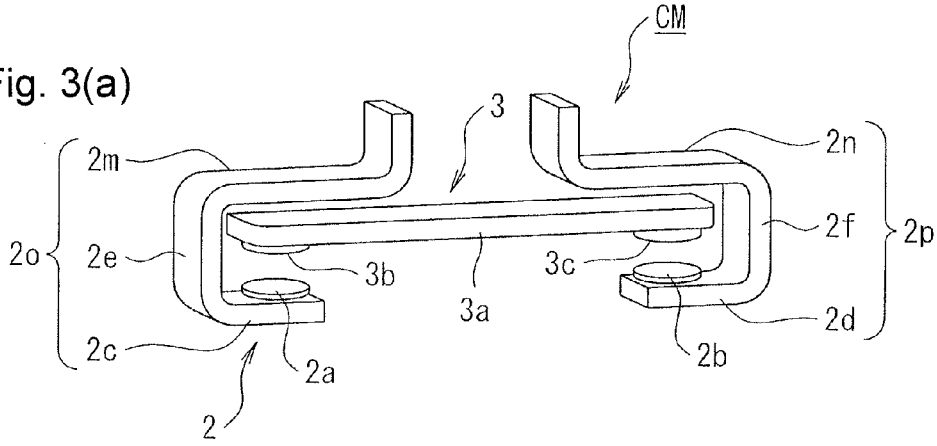
FIGS. 3(*a*)-3(*c*) are views showing a second embodiment of the contact mechanism of the present invention, wherein FIG. 3(*a*) is a perspective diagram, FIG. 3(*b*) is a cross-sectional diagram of the opened contact mechanism, and FIG. 3(*c*) is a cross-sectional diagram of the closed contact mechanism.
Figure 3B:
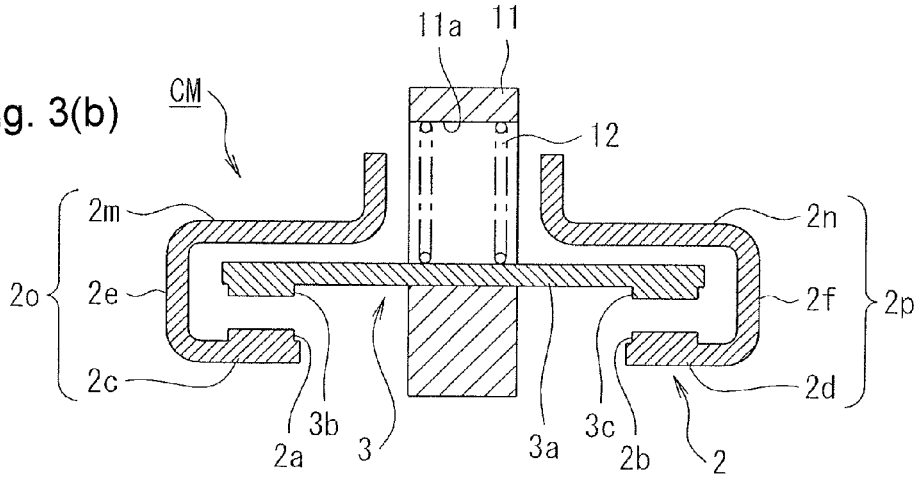
Figure 3C:
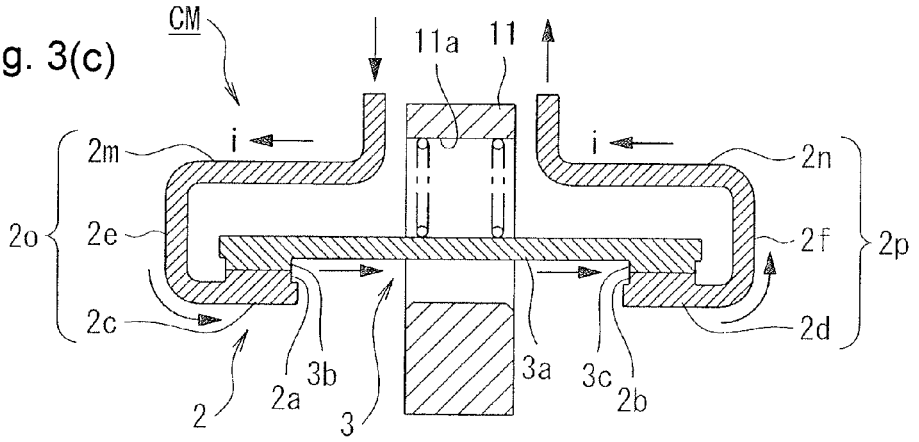

In other words, the second embodiment has the same configuration as that of the first embodiment, except that the second embodiment has a configuration shown in FIGS. 3(*a*)-3(*c*) in which, according to the configuration of the first embodiment shown in FIG. 2(*a*)-2(*d*), the second conductive plate parts 2*e*, 2*f* of the L-shaped conductive plate parts 2*g*, 2*h* of the fixed contact 2 are bent so as to cover upper ends of the end parts of the conductive plate 3*a* of the movable contact 3 to form third conductive plate parts 2*m*, 2*n* parallel to the conductive plate 3*a*, thereby configuring U-shaped conductive parts 2*o*, 2*p*.

According to the second embodiment, when the electromagnetic coil 8 of the operating electromagnet 4 is in a non-conductive state, no attracting force acts between the fixed core 5 and the movable core 6. Therefore, as with the first embodiment described above, the movable core 6 and the contact holder 11 are urged upward by the spring force of the return spring 9, obtaining an opened state of the contact mechanism CM, as shown in FIG. 3(*b*).

In the opened state of the contact mechanism CM, when a single-phase AC is applied to the electromagnetic coil 8 of the operating electromagnet 4, an attracting force is generated in the fixed core 5, attracting the movable core 6 downward against the return spring 9. As a result, the contact holder 11 descends, and the movable contact point parts 3*b*, 3*c* of the movable contact 3 are contacting with the fixed contact point parts 2*a*, 2*b* of the fixed contact 2 by the contact pressure of the contact spring 12 as shown in FIG. 3(*c*), obtaining a closed state of the contact mechanism CM.

When the contact mechanism CM enters the closed state, a large current of approximately, for example, several tens of kA, which is input from the external connecting terminal 2*i* of the fixed contact 2 connected to the DC power source (not shown), is supplied to the movable contact point part 3*b* of the movable contact 3 via the third conductive plate part 2*m*, the second conductive plate part 2*e*, the first conductive plate part 2*c*, and the fixed contact point part 2*a*. The large current supplied to the movable contact point part 3*b* is supplied to the fixed contact point part 2*b* via the conductive plate 3*a* and the movable contact point part 3*c*. The large current supplied to the fixed contact point part 2*b* is supplied to the first conductive plate part 2*d*, the second conductive plate part 2*f*, the third conductive plate part 2*n*, and the external connecting terminal 2*j*, forming a current-carrying path supplied to an external load.

At this moment, an electromagnetic repulsion is generated in a direction of opening the movable contact point parts 3*b*, 3c, between each of the fixed contact point parts 2a, 2b of the fixed contact 2 and each of the movable contact point parts 3b, 3c of the movable contact 3.

However, because the fixed contact 2 has the U-shaped conductive plate parts 2o, 2p formed by the first conductive plate parts 2c, 2d, the second conductive plate parts 2e, 2f and the third conductive plate parts 2m, 2n as shown in FIG. 3, currents flow in opposite directions in the third conductive plate parts 2m, 2n of the fixed contact 2 and the conductive plate 3a of the movable contact 3 that faces the third conductive plate parts 2m, 2n. For this reason, based on the relationship of magnetic fields formed by the third conductive plate parts 2m, 2n of the fixed contact 2 to the current flowing through the conductive plate 3a of the movable contact 3, the Lorentz force pushing the conductive plate 3a of the movable contact 3 against the fixed contact point parts 2a, 2b of the fixed contact 2 can be generated according to Fleming's left-hand rule. This Lorentz force can act against the abovementioned electromagnetic repulsion in the opening direction, which is generated between each of the fixed contact point parts 2a, 2b of the fixed contact 2 and each of the movable contact point parts 3b, 3c of the movable contact 3, preventing the movable contact point parts 3b, 3c of the movable contact 3 from being opened.

In the second embodiment as well, the simple configuration of forming the U-shaped conductive plate parts 2o, 2p in the fixed contact 2 can easily generate the Lorentz force that acts against the abovementioned electromagnetic repulsion in the opening direction, which is generated between the fixed contact 2 and the movable contact 3. Therefore, the same effects as those described in the first embodiment can be obtained.

Next, a third embodiment of the present invention is described with reference to FIGS. 4(a)-4(c).

Unlike the second embodiment, the third embodiment forms U-shaped folded parts in the movable contact.

Figure 4A:
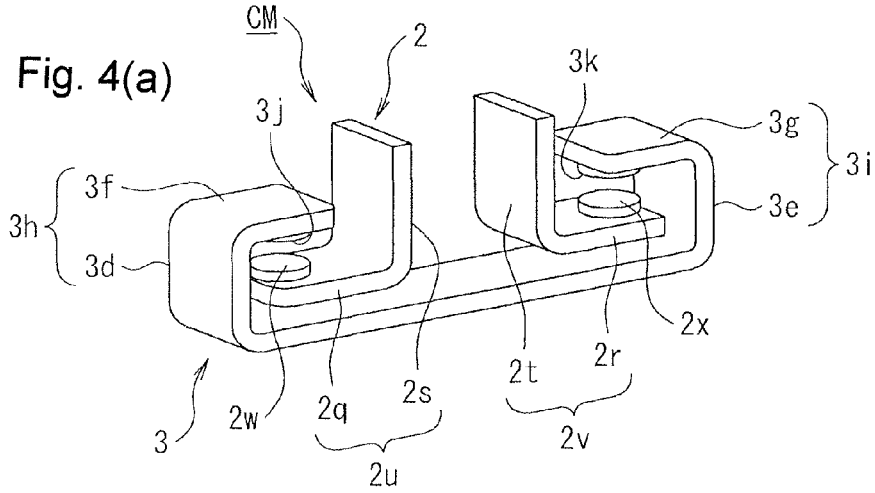
FIGS. 4(*a*)-4(*c*) are views showing a third embodiment of the contact mechanism of the present invention, wherein FIG. 4(*a*) is a perspective view, FIG. 4(*b*) is a cross-sectional view of the opened contact mechanism, and FIG. 4(*c*) is a cross-sectional view of the closed contact mechanism.
Figure 4B:
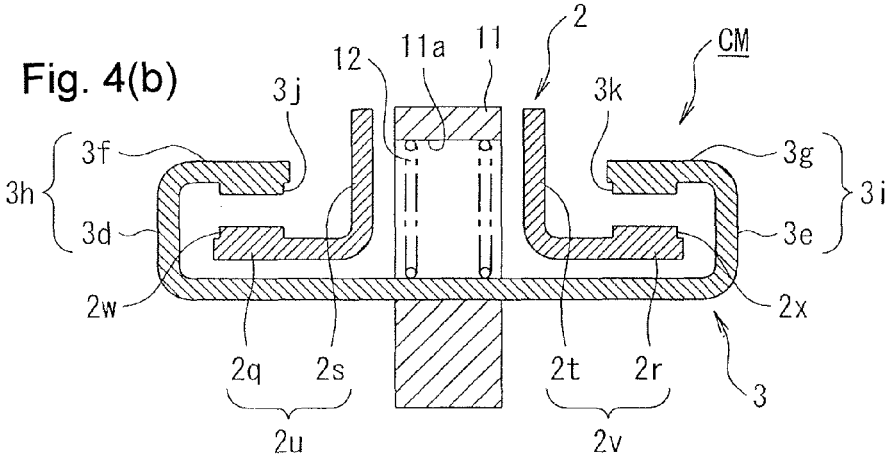
Figure 4C:
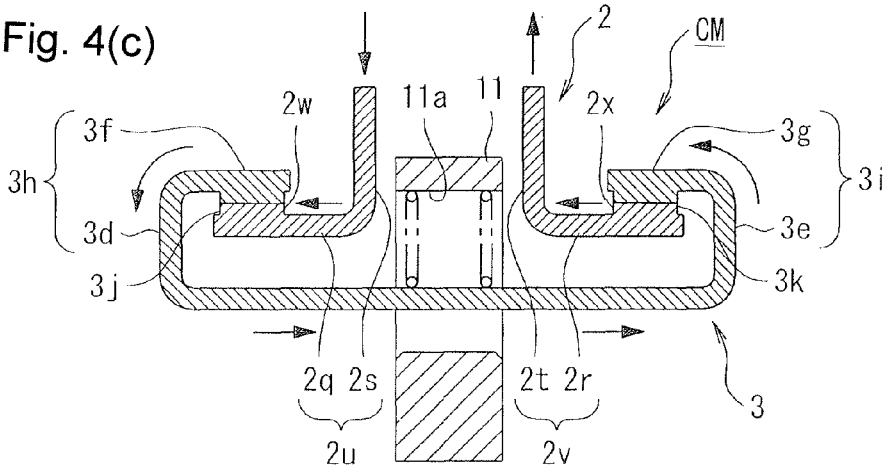
Figure 5A:
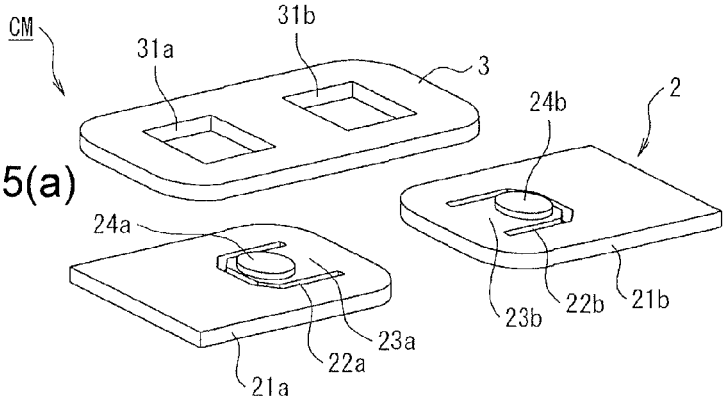
FIGS. 5(*a*)-5(*d*) are views showing a fourth embodiment of the present invention, wherein FIG. 5(*a*) is a perspective view, FIG. 5(*b*) is a cross-sectional view of the opened contact mechanism, FIG. 5(*c*) is a cross-sectional view of the closed contact mechanism, and FIG. 5(*d*) is an explanatory view showing a current direction obtained when the contact mechanism is closed.
Figure 5B:
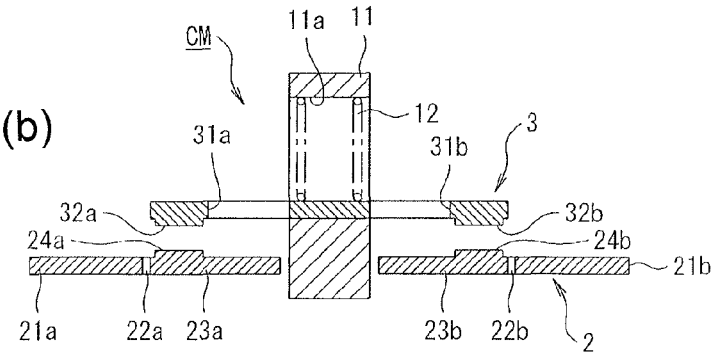
Figure 5C:
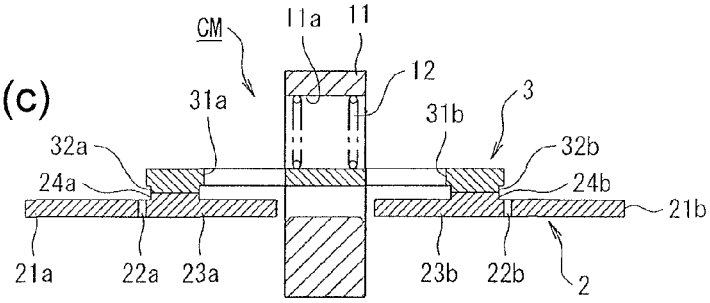
Figure 5D:
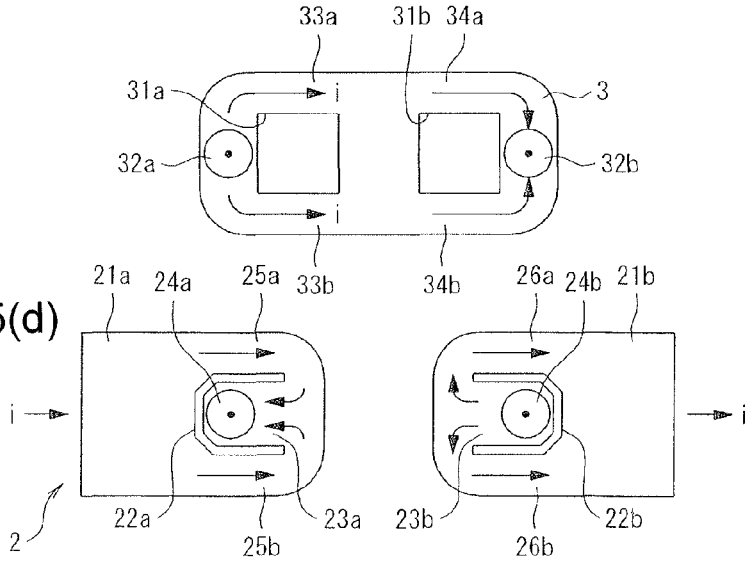

In other words, in the third embodiment, U-shaped folded parts 3h, 3i that are folded above the conductive plate 3a are formed by first conductive plate parts 3d, 3e extending upward from the ends of the conductive plate 3a of the movable contact 3 and second conductive plate parts 3f, 3g that extend inward from upper ends of the first conductive plate parts 3d, 3e, as shown in FIGS. 4(a) to 4(c). Movable contact point parts 3j, 3k are formed on lower surfaces of tip ends of the second conductive plate parts 3f, 3g of these U-shaped folded parts 3h, 3i.

Furthermore, in an opened state of the contact mechanism CM, the fixed contact 2 has L-shaped conductive plate parts 2u, 2v, which are formed by fourth conductive plate parts 2q, 2r that extend inward facing the conductive plate 3a and the second conductive plate parts 3f, 3g configuring the U-shaped folded parts 3h, 3i of the movable contact 3, and fifth conductive plate parts 2s, 2t that extend upward from internal ends of the fourth conductive plate parts 2q, 2r through the insides of inner end parts of the U-shaped folded parts 3h, 3i of the movable contact 3. In addition, the fourth conductive plate parts 2q, 2r have fixed contact point parts 2w, 2x that are formed so as to face the movable contact point parts 3j, 3k of the movable contact 3.

According to the third embodiment, when the electromagnetic coil 8 of the operating electromagnet 4 is in a non-conductive state, the movable core 6 is moved upward by the return spring 9, whereby the contact holder 11 comes into abutment with the stopper 13. At this moment, in the contact mechanism CM, the conductive plate 3a of the movable contact 3 is abutting with the bottom part of the insertion hole 11a by the contact spring 12, as shown in FIG. 4(b). Furthermore, the fourth conductive plate parts 2q, 2r of the fixed contact 2 are positioned in middle parts between the conductive plate 3a and the second conductive plate parts 3f, 3g configuring the U-shaped folded parts 3h, 3i, thereby separating the fixed contact point parts 2w, 2x downward from the movable contact point parts 3j, 3k. As a result, the contact mechanism CM enters the opened state.

In the opened state of the contact mechanism CM, when a single-phase AC is applied to the electromagnetic coil 8 of the operating electromagnet 4, the fixed core 5 attracts the movable core 6 against the return spring 9. As a result, the contact holder 11 descends. Consequently, the movable contact point parts 3j, 3k of the movable contact 3 contact with the fixed contact point parts 2w, 2x of the fixed contact 2, obtaining a closed state of the contact mechanism CM, as shown in FIG. 4(c).

When the contact mechanism CM enters the closed state, a large current of approximately, for example, several tens of kA, which is input from the external connecting terminal 2i of the fixed contact 2 connected to the DC power source (not shown), is supplied to the movable contact point part 3j of the movable contact 3 via the fifth conductive plate part 2s, the fourth conductive plate part 2q, and the fixed contact point part 2w. The large current supplied to the movable contact point part 3j is supplied to the fixed contact point part 2x via the second conductive plate part 3f, the first conductive plate part 3d, the conductive plate 3a, the first conductive plate part 3e, the second conductive plate part 3g, and the movable contact point part 3k. As a result, a current-carrying path is formed in which the large current supplied to the fixed contact point part 2x is supplied to an external load via the fourth conductive plate part 2r, the fifth conductive plate part 2t, and the external connecting terminal 2j.

At this moment, an electromagnetic repulsion is generated in a direction of opening the movable contact point parts 3i, 3k, between each of the fixed contact point parts 2w, 2x of the fixed contact 2 and each of the movable contact point parts 3j, 3k of the movable contact 3.

However, because the movable contact 3 has the U-shaped folded parts 3h, 3i formed by the conductive plate 3a, the first conductive plate parts 3d, 3e, and the second conductive plate parts 3f, 3g as shown in FIGS. 4(a)-4(c), currents flow in opposite directions in the conductive plate 3a of the movable contact 3 and the fourth conductive plate parts 2q, 2r of the fixed contact 2. For this reason, the current flowing through the conductive plate 3a of the movable contact 3 and magnetic fields formed by the fourth conductive plate parts 2q, 2r of the fixed contact 2 can generate the Lorentz force in the conductive plate 3a to push the movable contact point parts 3j, 3k of the movable contact 3 against the fixed contact point parts 2w, 2x of the fixed contact 2, as shown in FIG. 4(c). This Lorentz force can act against the abovementioned electromagnetic repulsion in the opening direction, which is generated between each of the fixed contact point parts 2w, 2x of the fixed contact 2 and each of the movable contact point parts 3j, 3k of the movable contact 3, preventing the movable contact point parts 3j, 3k of the movable contact 3 from being opened upon application of a large current.

Also, in the third embodiment, because the L-shaped conductive plate parts 2u, 2v are formed in the fixed contact 2, a magnetic flux reinforcement part is formed above the second conductive plate parts 3f, 3g of the movable contact 3 by the fifth conductive plate parts 2s, 2t of the L-shaped conductive plate parts 2u, 2v. For this reason, the Lorentz force similar to that of the first embodiment described above can be generated, more strongly preventing the movable contact 3 from being opened.

Next, a fourth embodiment of the present invention is described with reference to FIGS. 5(*a*)-5(*d*).

In the fourth embodiment, the fixed contact and the movable contact are formed into flat plates to generate the Lorentz force acting against the electromagnetic repulsion in the opening direction.

In other words, in the fourth embodiment, the fixed contact 2 and the movable contact 3 that configure the contact mechanism CM are formed into flat plates, as shown in FIGS. 5(*a*) to 5(*d*). The fixed contact 2 has flat conductors 21*a*, 21*b* that are disposed at a regular interval and have rectangular shapes as viewed planarly. These flat conductors 21*a*, 21*b* are formed to be line-symmetric. U-shaped grooves 22*a*, 22*b*, whose open end surfaces form internal end surfaces, are pierced on the front and back of flat conductors 21*a*, 21*b* so as to face longitudinal end parts of the movable contact 3. Fixed contact point part 24*a*, 24*b* are formed on opposing surfaces of plate parts 23*a*, 23*b* that face the movable contact 3 and are surrounded by the U-shaped grooves 22*a*, 22*b*.

In the movable contact 3, on the other hand, square through-holes 31*a*, 31*b* are formed at a regular interval in positions that face the plate parts 23*a*, 23*b* surrounded by the U-shaped groves 22*a*, 22*b* of the flat conductors 21*a*, 21*b* of the fixed contact 2. Movable contact point parts 32*a*, 32*b* are formed on lower surfaces of external end parts of the through-holes 31*a*, 31*b* that face the fixed contact point parts 24*a*, 24*b* of the fixed contact 2.

According to the fourth embodiment, as with the first to third embodiments described above, when the electromagnetic coil 8 of the operating electromagnet 4 is in a non-conductive state, the movable core 6 is moved upward by the return spring 9. Therefore, the contact holder 11 is moved upward to a position shown in FIG. 5(*b*). Consequently, the flat conductors 21*a*, 21*b* of the fixed contact 2 separate from the movable contact 3, and the fixed contact point parts 24*a*, 24*b* of the flat conductors 21*a*, 21*b* separate from the movable contact point parts 32*a*, 32*b*, obtaining an opened state of the contact mechanism CM.

In the opened state of the contact mechanism CM, when a single-phase AC is supplied to the electromagnetic coil 8 of the operating electromagnet 4, the fixed core 5 attracts the movable core 6 against the return spring 9. As a result, the contact holder 11 descends. Consequently, the fixed contact point parts 24*a*, 24*b* of the fixed contact 2 of the contact mechanism CM contact with the movable contact point parts 32*a*, 32*b* of the movable contact 3, obtaining a closed state of the contact mechanism CM.

In the closed state of the contact mechanism CM, a large current of, for example, a DC power source is input from the external connecting terminal 2*i* to a left end of the flat conductor 21*a*. Because the fixed contact point part 24*a* is formed in the plate part 23*a* surrounded by the U-shaped groove 22*a*, the large current that is input to the flat conductor 21*a* enters the plate part 23*a* via side plate parts 25*a*, 25*b* formed on either side surface of the U-shaped groove 22*a*, and is supplied from the fixed contact point part 24*a* to the movable contact point part 32*a* of the movable contact 3.

The large current supplied to the movable contact point part 32*a* passes through side plate parts 33*a*, 33*b* formed on either side surface of the through-hole 31*a*, and is supplied from the movable contact point part 32*b* to the fixed contact point part 24*b* of the flat conductor 21*b* via side plate parts 34*a*, 34*b* formed on either side surface of the through-hole 31*b*.

The large current supplied to the fixed contact point part 24*b* passes through side plate parts 26*a*, 26*b* formed on either side surface of the U-shaped groove 22*b*, from the plate part 23*b*, and is supplied from a right end of the flat conductor 21*b* to a load via the external connecting terminal 2*j*.

At this moment, currents flow in the same direction in the side plate parts 25*a*, 25*b* of the flat conductor 21*a* of the fixed contact 2 and the side plate parts 33*a*, 33*b* of the movable contact 3, the side plate parts 25*a*, 25*b* and the side plate parts 33*a*, 33*b* facing each other. Similarly, currents flow in the same direction in the side plate parts 34*a*, 34*b* of the movable contact 3 and the side plate parts 26, 26*b* of the flat conductor 21*b* of the fixed contact 2, the side plate parts 34*a*, 34*b* and the side plate parts 26*a*, 26*b* facing each other.

Therefore, according to Fleming's left-hand rule, downward Lorentz force is generated in the side plate parts 33*a*, 33*b* and 34*a*, 34*b* of the movable contact 3. This Lorentz force can prevent an electromagnetic repulsion in an opening direction from being generated between each of the fixed contact point parts 24*a*, 24*b* and each of the movable contact point parts 32*a*, 32*b*, preventing the movable contact 3 from being opened. Thus, the same effects as those described in the first to third embodiments can be obtained.

Note that each of the embodiments has described the AC excitation of the operating electromagnet 4; however, an operating electromagnet for DC excitation may be applied. Moreover, the drive mechanism for the movable contact point 3 is not limited to the configurations described above, and a drive mechanism with any configuration can be applied.

In addition, each of the embodiments has described a situation where the contact mechanism CM of the present invention is applied to an electromagnetic contactor. However, the present invention is not limited thereto, and the contact mechanism CM can be applied to any equipment such as a switch.

INDUSTRIAL APPLICABILITY

The present invention can provide a contact mechanism, in which at least a fixed contact or a movable contact is configured so as to generate a Lorentz force that acts against an electromagnetic repulsion in an opening direction that is generated in the fixed contact or the movable contact upon application of a large current, and which is capable of preventing the movable contact from being opened upon application of a large current. The present invention can also provide an electromagnetic contactor that uses this contact mechanism.

EXPLANATION OF REFERENCE NUMERALS

1 . . . Main body case, 1*a* . . . Upper case, 1*b* . . . Lower case, 2 . . . Fixed contact point, 2*a*, 2*b* . . . Fixed contact point part, 2*c*, 2*d* . . . First conductive plate part, 2*e*, 2*f* . . . Second conductive plate part, 2*g*, 2*h* . . . L-shaped conductive plate part, 2*i*, 2*j* . . . External connecting terminal, 2*m*, 2*n* . . . Third conductive plate part, 2*o*, 2*p* . . . U-shaped conductive plate part, 2*q*, 2*r* . . . Fourth conductive plate part, 2*s*, 2*t* . . . Fifth conductive plate part, 2*u*, 2*v* . . . L-shaped conductive plate part, 2*w*, 2*x* . . . Fixed contact point part, Movable contact, 3*a* . . . Conductive plate part, 3*b*, 3*c* . . . Movable contact point part, 3*d*, 3*e* . . . First conductive plate part, 3*f*, 3*g* . . . Second conductive plate part, 3*h*, 3*i* . . . U-shaped folded part, 3*j*, 3*k* . . . Movable contact point part, 4 . . . Operating electromagnet, 5 . . . Fixed core, 6 . . . Movable core, 8 . . . Electromagnetic coil, 9 . . . Return spring, 11 . . . Contact holder, 12 . . . Contact spring, 13 . . . Stopper, 21*a*, 21*b* . . . Flat conductor, 22*a*, 22*b* . . . U-shaped groove, 23*a*, 23*b* . . . Plate part, 24*a*, 24*b* . . . Fixed contact point part, 31*a*, 31*b* . . . Through-hold, 41 . . . Power line, 42 . . . Arrester, 43 . . . U-shaped folded part

What is claimed is:

1. A contact mechanism, comprising:

a movable contact comprising a conductive plate supported by a movable part, and a pair of movable contact point parts on two ends of the conductive plate; and fixed contacts, each being formed facing each of the two ends of the conductive plate and comprising a first conductive plate part supporting a fixed contact point part facing one of the pair of movable contact point parts facing thereto, and extending outwardly from one end of the conductive plate in parallel with the conductive plate, a second conductive plate part extending from an outer end part of the first conductive plate part through outside of an end part of the conductive plate to form an L-shape with the first conductive plate part, and a third conductive plate part extending inwardly from an end part of the second conductive plate part in parallel with the conductive plate to form a U-shape with the first conductive plate part and the second conductive plate part, wherein the first conductive plate part, the second conductive plate part, and the third conductive plate part have a uniform width throughout the U-shape, and directly face the movable contact, and a current flows in opposite directions in the third conductive plate part and the conductive plate to generate a Lorentz force acting against an electromagnetic repulsion in an opening direction of the movable contact generated between the fixed contacts and the movable contact upon conduction of the current.

2. An electromagnetic contactor, comprising:

the contact mechanism according to claim 1, wherein the movable contact is coupled to a movable core of an operating electromagnet, and the fixed contacts are connected to an external connecting terminal.

3. A contact mechanism, comprising:

a movable contact comprising a conductive plate part supported by a movable part, U-shaped folded parts formed on two ends of the conductive plate part, and a pair of movable contact point parts each formed on an opposing surface of each of the U-shaped folded parts facing the conductive plate part; and a fixed contact comprising a pair of first conductive plate parts respectively comprising a pair of fixed contact point parts on each end part of the pair of first conductive plate parts to contact with the pair of movable contact point parts of the movable contact disposed parallel to the conductive plate part in the U-shaped folded parts, and a pair of second conductive plate parts each extending from an inner end of each of the pair of first conductive plate parts through an inner side of an end part of each of the U-shaped folded parts to form an L-shape with the first conductive plate part, wherein the U-shaped folded parts have a uniform width throughout thereof, and directly face the pair of first conductive plate parts in the U-shaped folded parts, and a current flows in opposite directions in the pair of first conductive plate parts and the conductive plate part to generate a Lorentz force acting against an electromagnetic repulsion in an opening direction generated between the fixed contact and the movable contact upon conduction of the current.

4. An electromagnetic contactor, comprising:

the contact mechanism according to claim 3, wherein the movable contact is coupled to a movable core of an operating electromagnet, and the fixed contact is connected to an external connecting terminal.

5. The contact mechanism according to claim 3, wherein the pair of first conductive plate parts and the pair of second conductive plate parts have a uniform width throughout the L-shape.

* * * * *

UNITED STATES PATENT AND TRADEMARK OFFICE

CERTIFICATE OF CORRECTION

PATENT NO. : 8,816,803 B2
APPLICATION NO. : 13/640612
DATED : August 26, 2014
INVENTOR(S) : Yasuhiro Naka et al.

It is certified that error appears in the above-identified patent and that said Letters Patent is hereby corrected as shown below:

In the Specification

Please change column 1, lines 40 to 41, from "... Patent Literature 2;..." to -- Patent Literature 2, --.

Please change column 4, line 19, from "... case has a divided..." to -- case 1 has a divided --.

Please change column 4, line 49, from "... contact by..." to -- contact 2 by --.

Please change column 10, line 56, from "... Movable contact,..." to -- 3...Movable contact, --.

Signed and Sealed this
Seventeenth Day of February, 2015

Michelle K. Lee

Michelle K. Lee
*Deputy Director of the United States Patent and Trademark Office*